US005988715A

United States Patent [19]

Mason

[11] Patent Number: 5,988,715

[45] Date of Patent: Nov. 23, 1999

[54] APPARATUS FOR CLEANING DRAIN GUTTERS

[76] Inventor: Bessie Mason, 1010 Hapmton Rd., Petersburg, Va. 23805

[21] Appl. No.: 09/178,233

[22] Filed: Oct. 23, 1998

[51] Int. Cl.[6] ..... E04D 13/076

[52] U.S. Cl. ..... 294/19.1; 15/236.04; 239/532

[58] Field of Search ..... 294/19.1, 24, 49, 294/55; 15/236.04; 239/532; 401/137, 289

[56] References Cited

U.S. PATENT DOCUMENTS

| | | | |
|---|---|---|---|
| 3,023,971 | 3/1962 | Milhous | 294/19.1 X |
| 3,041,655 | 7/1962 | Entler | 294/19.1 X |
| 4,303,348 | 12/1981 | O'Brien | 401/137 |
| 4,310,940 | 1/1982 | Moore | 15/105 |
| 4,319,851 | 3/1982 | Arthur | 401/137 |
| 4,447,927 | 5/1984 | Malless, Jr. | 15/236 |
| 4,848,818 | 7/1989 | Smith | 294/19.1 |
| 5,288,118 | 2/1994 | Hartselle, III | 294/19.1 |
| 5,435,612 | 7/1995 | Kreiser | 294/19.1 |
| 5,626,377 | 5/1997 | Carroll et al. | 294/19.1 |

FOREIGN PATENT DOCUMENTS

| | | | |
|---|---|---|---|
| 1045763 | 1/1979 | Canada | 294/19.1 |
| 1559925 | 1/1980 | United Kingdom | 294/19.1 |

*Primary Examiner*—Johnny D. Cherry
*Attorney, Agent, or Firm*—Norman B. Rainer

[57] ABSTRACT

An apparatus for cleaning an overhead drain gutter associated with the lower extremity of a pitched roof includes a scoop member, a pole of telescopically adjustable length, and an attachment member of inverted U-shaped configuration that extends in joinder between the scoop member and pole. The scoop member is of elongated shape, having front and rear ends. The rear end may be provided with a retaining wall disposed transversely to the direction of elongation, and a water discharge nozzle may be disposed within the retaining wall.

5 Claims, 1 Drawing Sheet

11
38
13
43
35
12
37
20
27
25
23
32
29
34
30
10
31
14
30
33
16
39
20
17
19
24
37

21
26
27
24
22
25
16
23
15
16
38
29

24
13
41
25
12
18
14
28

APPARATUS FOR CLEANING DRAIN GUTTERS

BACKGROUND OF THE INVENTION

1. Field of the Invention

This invention concerns apparatus for cleaning an overhead drain gutter associated with the lower extremity of a pitched roof.

2. Description of the Prior Art

Most residential-type houses are constructed with pitched roofs. The sloped or angled nature of the roof prevents the accumulation of water, and in many instances minimizes the accumulation of snow. At the lowest extremity of a pitched roof, generally referred to as the eave, there is positioned a drain trough or gutter, the purpose of which is to catch the water which runs off the roof, and channel it to a downspout which leads the water away from the foundation of the house.

In the course of time, such drain gutters tend to accumulate airborne detritus such as fallen leaves, which obstruct the gutter and render it ineffective for its intended purpose. The considerable weight of the debris plus entrapped stagnant water causes the trough to sag, warp and eventually pull away from the eave.

The cleaning of the trough is often done manually by climbing onto the roof or by employing a ladder which is leaned against the trough. Either approach is difficult and often perilous. Furthermore, the ladder tends to damage the gutter.

Various means have, therefore, been developed to prevent the deposition and accumulation of debris in gutters and/or downspouts. Such preventive means include screens and shield devices placed over the top of the gutter. However, it has been found that materials of small size such as, for example, sand from shingles, insects, seedlings and the like thwart the preventive devices, whereby the undesired accumulations still result. While the preventive device can be lifted up to clean the gutters and/or the openings of the downspouts, this is not easily done.

Another means of preventing accumulations of debris, particularly in the downspouts, is the insertion of a wire bulb screen unit in the collar of the downspout. However, once a few leaves fall on the screen they tend to stick to it, particularly if they are wet. Eventually, more and more debris accumulates around and on top of these leaves so that the drain becomes clogged and the water accumulating in the gutters has to flow over the sides.

Devices utilizing long poles have earlier been disclosed for enabling a person to clean a gutter while standing upon the ground beneath the gutter. Such devices are disclosed for example in U.S. Pat. Nos. 4,196,927; 4,310,940; 4,319,851; 5,626,327; and 5,288,118. Such devices generally employ a working head positioned atop the pole and configured to seat downwardly into the gutter. The head functions either to push, scoop, lift or grab debris within the gutter. By moving the head laterally along the gutter in successive manipulations, the debris is removed. In those devices where the head contains moving components, a lever, rope or other elongated force-conveying manipulation means extends between the head and the lower extremity of the pole.

The aforesaid gutter-cleaning devices are generally difficult to use because of their relatively heavy weight. The head component is usually not easily separable from the pole component, thereby presenting difficulties in packaging for marketing purposes and in storage by the user. The head component in many such devices is subject to malfunction during interaction with the debris in the gutter.

It is accordingly an object of the present invention to provide apparatus for cleaning an eaves drain gutter.

It is a further object of this invention to provide apparatus as in the foregoing object which can be hand-operated by a person standing upon the ground below said gutter.

It is another object of the present invention to provide apparatus of the aforesaid nature easily amenable to disassembly to a compact state which facilitates marketing distribution and storage.

It is yet another object of this invention to provide apparatus of the aforesaid nature which is of light weight, and simple and durable construction amenable to low cost manufacture.

These objects and other objects and advantages of the invention will be apparent from the following description.

SUMMARY OF THE INVENTION

The above and other beneficial objects and advantages are accomplished in accordance with the present invention by an apparatus comprising:

1) a scoop having front and rear ends and further bounded by bottom and side portions which in combination define an interior region and an outer surface,
2) an attachment member connected to said scoop adjacent said rear end and having a substantially inverted U-shaped configuration having a distal free end positioned adjacent a side portion of said scoop, and
3) a pole of telescopically adjustable length having upper and lower free extremities, said upper extremity being removably connectable with the distal free end of said attachment member.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figures 1, 2, 3, 4:
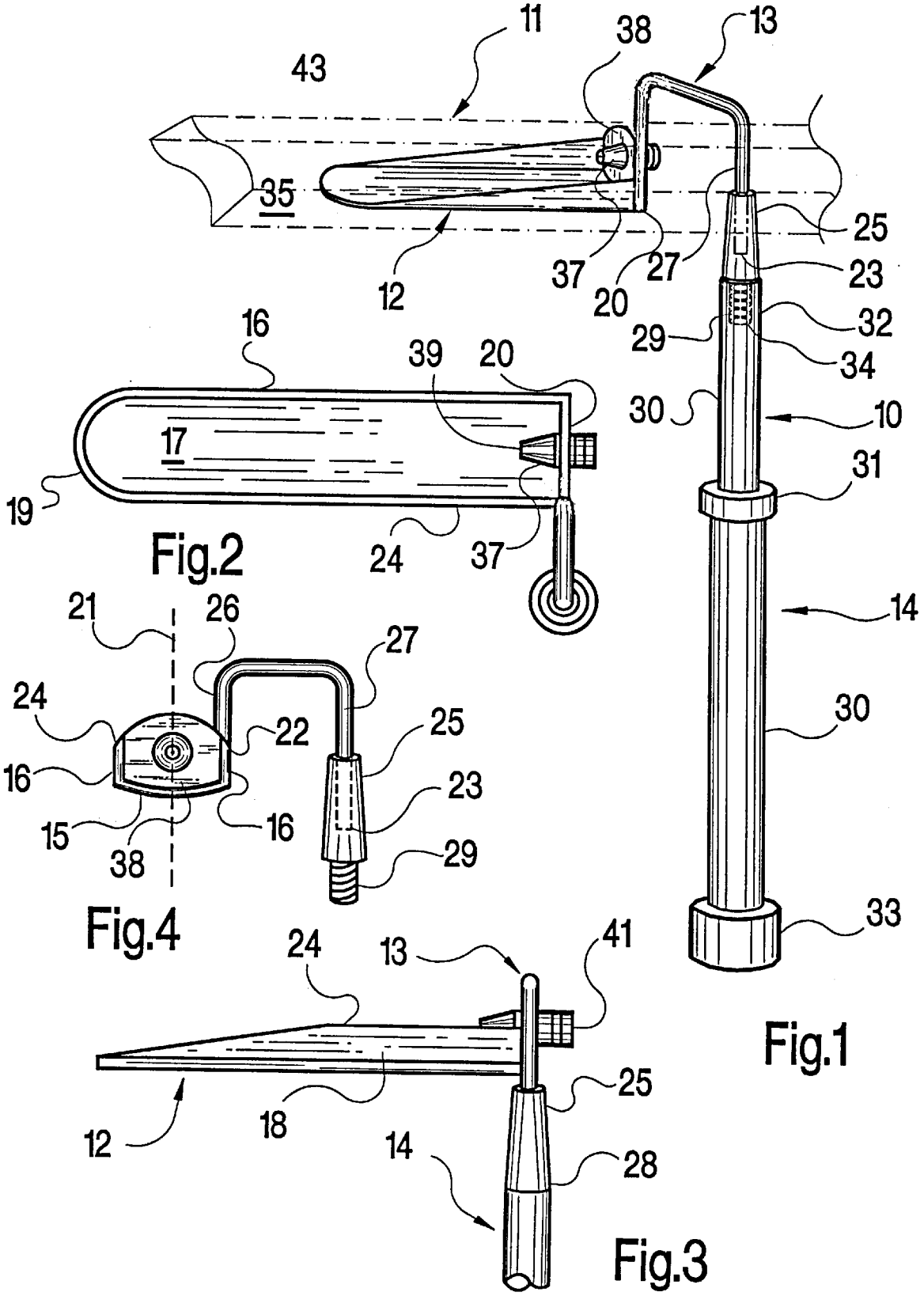
FIG. 1 is a top and rear perspective view of an embodiment of the gutter cleaning apparatus of the present invention.
FIG. 2 is a top plan view.
FIG. 3 is a front end view.
FIG. 4 is a side view.

Referring now to FIGS. 1–4, an embodiment of the gutter cleaning device 10 of the present invention is shown in operative association with a conventional eaves drain gutter 11. The cleaning device 10 is comprised of a scoop 12 supported by attachment member 13 removably joined to pole 14.

The exemplified embodiment of the scoop 12 is of monolithic metal construction, having the general shape of a garden trowel and comprised of bottom portion 15 and opposed side portions 16 which terminate upwardly in perimeter lip 24. Said bottom and side portions define an interior region 17 and an outer surface 18. The scoop is further characterized in having an elongated contour extending between front and rear ends 19 and 20, respectively. The bottom portion 15 of the exemplified scoop embodiment is rounded convexly downward. However, in alternative embodiments bottom portion 15 may be flat. The exemplified scoop embodiment is also shown to have a plane of symmetry 21 which passes vertically through said bottom portion in the direction of said elongation, and spaced mid-way between said side portions. Other scoop embodiments may, however, have non-symmetrical shapes. A retaining wall 38 may be disposed in said scoop at rear end 20 and aligned transversely to said direction of elongation.

Attachment member 13 is preferably fabricated of a metal rod suitably bent to a substantially U-shaped inverted configuration having a first arm 26 terminating in downwardly directed proximal extremity 22 attached to scoop 12, and a second arm 27 terminating in downwardly directed distal free extremity 23 positioned adjacent a side portion of the scoop. The site of attachment of member 13 to the scoop is on perimeter lip 24 adjacent rear end 20. The mode of such attachment is preferably by way of welding. An adapter collar 25, which may be of plastic construction, is disposed upon second arm 27. The lowermost extremity 28 of collar 25 is provided with male threading 29.

Pole 14 is comprised of 2 or 3 telescopically interactive tubular segments 30 which may be constructed of aluminum or other light weight, rigid materials. Locking means in the form of threaded collars 31 may be associated with the uppermost extremities of said segments to permit frictional gripping of the next interior segment, thereby stabilizing the overall length of pole 14. In alternative embodiments, however, the locking means may be in the form of a series of alignable apertures in the tubular segments and insertable means such as a pin or spring-urged pawl which engages said aligned apertures. Pole 14 extends between upper and lower free extremities 32 and 33, respectively. Said upper extremity 32 is provided with female threading 34 adapted to interact with the male threading 29 of adapter collar 25.

By virtue of the aforesaid specialized construction, the gutter cleaning device of this invention can be easily held and manipulated by a person standing upon the ground beneath the gutter. In use, the device is manipulated so that the bottom portion of the scoop is caused to slide upon the floor portion 35 of drain gutter 11. The scoop is then lifted, and the debris content within interior region 17 is dumped. Such procedure is repeated until the gutter is satisfactorily cleaned.

The device of this invention may be further equipped with water discharge means in the form of nozzle 37 attached to retaining wall 38. The forward extremity 39 of said nozzle contains a narrow bore adapted to direct a high velocity stream of water toward said interior region and beyond scoop 12 for the purpose of augmenting the cleaning of the gutter. A threaded rear extremity 41 of nozzle 37 is adapted to receive a garden hose, not shown, and which may be supported by pole 14.

While particular examples of the present invention have been shown and described, it is apparent that changes and modifications may be made thereto without departing from the invention in its broadest aspects. The aim of the appended claims, therefore is to cover all such changes and modifications as fall within the true spirit and scope of the invention.

Having thus described my invention, what is claimed is:

1. An apparatus for cleaning drain gutters comprising:

a) a scoop having front and rear ends and further bounded by bottom and opposed side portions elongated in the direction between said front and rear ends, said bottom and side portions in combination defining an interior region and an outer surface, and a retaining wall at said rear end aligned transversely to said direction of elongation, said scoop having a plane of symmetry which passes vertically through said bottom portion in said direction of elongation and spaced mid-way between said side portions, b) an attachment member connected to said scoop adjacent said rear end and having a substantially inverted U-shaped configuration having a distal extremity positioned adjacent a side portion of said scoop, c) a water discharge nozzle attached to said retaining wall and directed toward said interior region, and d) a pole of telescopically adjustable length having upper and lower free extremities, said upper extremity being removably connectable with the distal extremity of said attachment member.

2. The apparatus of claim 1 wherein said attachment member is fabricated of a metal rod suitably bent to said substantially U-shaped configuration having a first arm terminating in a downwardly directed proximal extremity connected to said scoop, and a second arm downwardly terminating in said distal extremity.

3. The apparatus of claim 2 wherein said proximal extremity is connected with said scoop at a site adjacent said rear end and upon said outer surface.

4. The apparatus of claim 2 wherein a threaded collar is disposed upon said second arm at said distal extremity.

5. The apparatus of claim 4 wherein the upper extremity of said pole is threaded in a manner to engage said collar.

* * * * *